United States Patent [19]

Sato

[11] 3,972,305

[45] Aug. 3, 1976

[54] IMAGING SYSTEM

[75] Inventor: Masamichi Sato, Tucson, Ariz.

[73] Assignee: Xerox Corporation, Stamford, Conn.

[22] Filed: Mar. 21, 1975

[21] Appl. No.: 560,743

Related U.S. Application Data

[60] Division of Ser. No. 346,215, March 29, 1973, which is a continuation of Ser. No. 807,353, March 14, 1969, abandoned.

[30] Foreign Application Priority Data

Apr. 11, 1969 Japan ..... 44-24283

[52] U.S. Cl. ..... 118/637; 355/10; 427/17; 118/DIG. 23

[51] Int. Cl.[2] ..... G03G 15/10

[58] Field of Search ..... 118/DIG. 23, 637, 410; 427/15, 17; 355/10; 96/1 LY

[56] References Cited

UNITED STATES PATENTS

| | | | |
|---|---|---|---|
| 3,162,104 | 12/1964 | Medley | 118/DIG. 23 |
| 3,169,887 | 2/1965 | York | 118/DIG. 23 |
| 3,196,832 | 7/1965 | Zin | 118/DIG. 23 |
| 3,334,613 | 8/1967 | Young | 118/DIG. 23 |
| 3,368,526 | 2/1968 | Matsumoto et al. | 118/637 |

*Primary Examiner*—Mervin Stein
*Assistant Examiner*—Douglas Salser

[57] ABSTRACT

Images are formed by transporting a recording surface bearing an electrostatic latent image adjacent to a spaced parallel surface of a development electrode and supplying a liquid developer between the recording surface and parallel surface of the development electrode at substantially the same velocity as the velocity of the recording surface.

6 Claims, 1 Drawing Figure

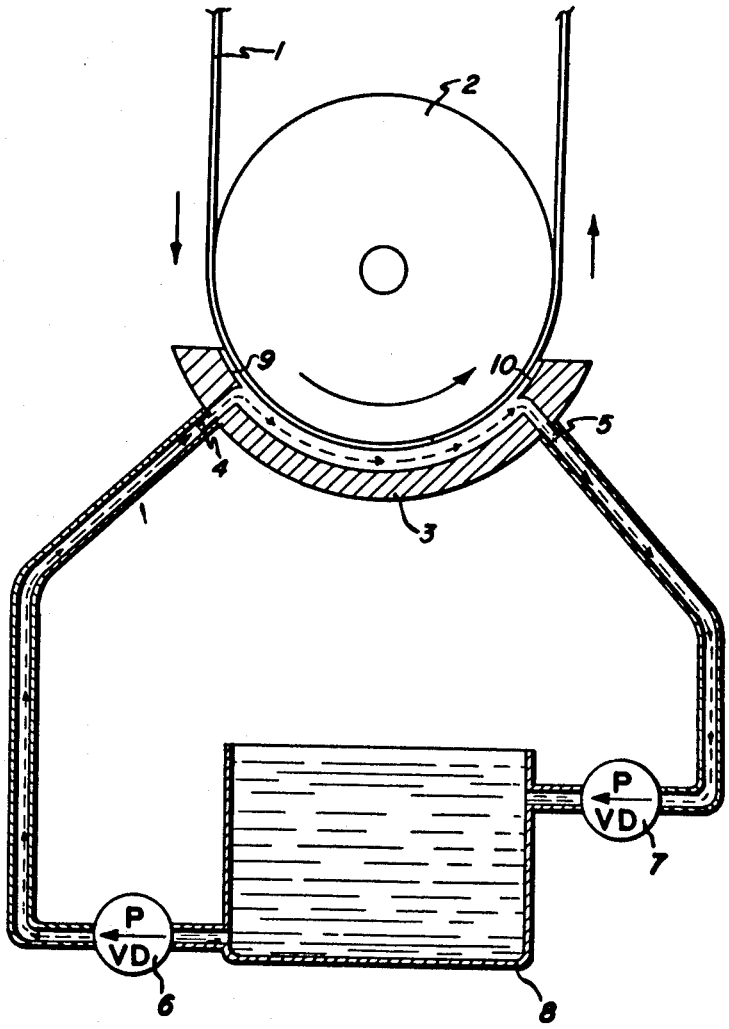
1
2
9
10
5
4
1
3
P
VD
7
P
VD
6
8

IMAGING SYSTEM

This application is a divisional application of continuation application Ser. No. 346,215, filed on Mar. 29, 1973, of parent application Ser. No. 807,353, filed on Mar. 14, 1969, now abandoned.

BACKGROUND OF THE INVENTION

This invention relates to imaging systems, and more particularly, to a improved method and apparatus for developing electrostatic latent images with a liquid developer.

The formation and development of images on the surface of photoconductive materials by electrostatic means is well known. One conventional process involves placing a uniform electrostatic charge on a photoconductive insulating layer comprising zinc oxide powder and a resinous binder carried on a conductive paper substrate, exposing the layer to a light-and-shadow image to dissipate the charge on the areas of the layer exposed to the light and developing the resulting electrostatic latent image by depositing on the image a charged toner which is dispersed in an insulating liquid. The charged toner may be suitably colored and may have a polarity of charge identical or opposite to that of the latent image to be developed. If the polarity of charge of the toner is identical to that of the latent image, reversal development will occur whereas a toner having a charge opposite to that of the latent image will be attracted to the latent image. Generally, a development electrode is employed with liquid development processes to eliminate the well-known edge effect. Since the electrostatic field resulting from the electrostatic latent image is relatively strong along the edges of the electrostatic latent image but relatively weak near the center of the electrostatic latent image, a print developed without the aid of a development electrode is characterized by dense toner deposits in the peripheral areas of the electrostatic latent image and relatively little or no toner deposits in the central areas of the electrostatic latent image. In order to eliminate this edge effect, it is necessary to position a development electrode close to the electrostatic latent image bearing surface during development. Generally, the closer the development electrode is positioned to the electrostatic latent image, the greater the reduction of edge effect. Unfortunately, at relatively high development speeds and close development electrode spacings, the deposited toner image tends to form streaks parallel to the direction of relative movement between the photoreceptor surface and liquid developer. Generally, liquid developers contain carrier liquids which are highly volatile and often inflammable. Exposure to the ambient atmosphere of liquid developers containing highly volatile and inflammable components is undesirable because of the danger to the machine operator. Thus, there is a continuing need for an improved imaging system.

SUMMARY OF THE INVENTION

It is, therefore, an object of this invention to provide an imaging system overcoming the above-noted deficiencies.

It is another object of this invention to provide an imaging technique which eliminates the edge effect in developed images.

It is a further object of this invention to provide an imaging technique which forms images with greater speed.

It is still another object of this invention to prevent volatile and inflammable liquid developer components from escaping to the ambient atmosphere.

It is another object of this invention to provide an imaging system which eliminates streaks in the deposited toner image.

It is a further object of this invention to provide an imaging system superior to those of known systems.

The above objects and others are accomplished by providing an imaging system in which a liquid developer is introduced in the space between an imaging surface and an adjacent development electrode at a velocity substantially equal to the velocity of the imaging surface so that little or no relative movement exists between the liquid developer and the imaging surface.

BRIEF DESCRIPTION OF THE DRAWING

The advantages of the improved electrostatographic imaging system of this invention will become even further apparent upon consideration of the following disclosure of the invention, particularly when taken in conjunction with the accompanying drawing wherein a schematic sectional view of an electrophotographic imaging apparatus employing an embodiment of the development electrode and the liquid developer supply means of this invention is illustrated.

DESCRIPTION OF THE PREFERRED EMBODIMENT

Referring now to a drawing, reference character 1 designates an electrophotographic recording web bearing an electrostatic latent image on a recording surface. The electrophotographic recording web 1 is supported by a portion of the periphery of a rotating conductive roller 2 while it is transported adjacent to but spaced from a development electrode 3. The development electrode 3 is fitted with a liquid developer inlet 4 and a liquid developer outlet 5. During development, an electrostatic latent image on the surface of electrophotographic recording web 1 facing away from conductive roller 2 is immersed in a liquid developer bath flowing from liquid developer inlet 4 to liquid developer outlet 5. The liquid developer inlet 4 and liquid developer outlet 5 comprise slots having a length approximately equal to the width of the electrophotographic web 1. The flow rate of the liquid developer is maintained at a velocity substantially equal to the peripheral speed of the conductive roller 2 by means of a variable delivery pump 6. A second variable delivery pump 7 may optionally be provided to promote flow of the developer from liquid developer outlet 5 to developer reservoir 8. Raised lips 9 and 10 at the entrance and exit ends, respectively, of development electrode 3 function as both seals and baffles to prevent loss of developer material and to direct the course of developer flow from inlet 4 to outlet 5. Suitable edge seals, not shown, may be employed to contain the liquid developer as the developer flows from inlet 4 to outlet 5. These seals may comprise, for example, felt strips arranged parallel to the flow of liquid developer and secured to each edge of development electrode 3. Although the photoreceptor illustrated in the drawing is a web, it is obvious that other configurations may be employed such as a belt, cylinder, plate and the like. Similarly, the development electrode may be flat, curved or any other suitable shape which will permit parallel spacing. The operating conditions for forming developed marking material images free of streaks depend upon factors such as the space between the electrostatic latent image bearing surface and development electrode, the surface potential of the electrostatic latent image, the relative speed between the electrostatic latent image bearing surface and the liquid developer and the length of the developing zone. Excellent images free of streaks and edge effect are obtained with processing speeds of about 40 centimeters per second. Processing speeds equaling the processing speed of current newspaper printing systems is believed possible with the imaging system of this invention.

The use of development electrodes in liquid developed systems is notoriously well known in the art. Conventional electrode liquid development spacings, voltages and materials may be employed in the process of this invention and are not considered the novel features of this invention.

The imaging technique of this invention, as may be clearly understood from the foregoing description, provides high quality, dense images free of streaks and edge effects. These improved images are realized by maintaining the flow velocity of a liquid developer at substantially the same velocity of an imaging surface during development at high speeds. Further, the high velocity circulation of the liquid developer between the development electrode and the imaging surface prevents developer marking particle depletion and prevents volatile and inflammable liquid developer components from escaping to the ambient atmosphere.

While the invention has been particularly shown and described with reference to the preferred embodiment thereof, other modifications and ramifications of the present invention will appear to those skilled in the art upon a reading of the disclosure. These are intended to be included within the scope of this invention.

What is claimed is:

1. An apparatus for forming images comprising means to support an electrostatographic imaging member having a recording surface, a development electrode having a leading edge extending transversely across at least the width of said recording surface and a trailing edge extending across at least the width of said recording surface wherein said development electrode is spaced from and parallel to at least a portion of said recording surface, means to transport said recording surface at a velocity of at least about 40 centimeters per second past said development electrode, pumping means to flow a liquid developer between said recording surface and said development electrode at a velocity substantially equal to the velocity of said recording surface so that little or no relative movement exists between said liquid developer and said recording surface to thereby avoid depletion of developer marking particle deposit on said recording surface, and a raised lip along said leading edge and a raised lip along said trailing edge of said development electrode to direct the flow of said liquid developer between said recording surface and said development electrode and to seal said liquid developer from exposure to the ambient atmosphere.

2. An apparatus according to claim 1 wherein said development electrode is provided with a slot adjacent said leading edge extending transversely across at least the width of said recording surface, said slot being operatively coupled to said pumping means to flow said liquid developer between said recording surface and said development electrode.

3. An apparatus according to claim 1 wherein said development electrode is provided with a slot adjacent said trailing edge extending transversely across at least the width of said recording surface, said slot being operatively coupled to said pumping means to flow said liquid developer out from between said recording surface and said development electrode.

4. An apparatus according to claim 1 wherein said pumping means comprises a variable speed pump.

5. An apparatus for forming images comprising means to support an electrostatographic imaging member having a recording surface, a development electrode having a leading edge extending transversely across at least the width of said recording surface and a trailing edge extending across at least the width of said recording surface wherein said development electrode is spaced from and parallel to at least a portion of said recording surface, means to transport said recording surface at a velocity of at least about 40 centimeters per second in an arcuate path past said development electrode, pumping means to flow a liquid developer between said recording surface and said development electrode at a velocity substantially equal to the velocity of said recording surface so that little or no relative movement exists between said liquid developer and said recording surface to thereby avoid depletion of developer marking particle deposit on said recording surface, and a raised lip along said leading edge and a raised lip along said trailing edge of said development electrode to direct the flow of said liquid developer between said recording surface and said development electrode and to seal said liquid developer from exposure to the ambient atmosphere.

6. An apparatus according to claim 5 wherein said pumping means comprises a variable speed pump.

* * * * *